US006287048B1

(12) United States Patent
Hollon et al.

(10) Patent No.: US 6,287,048 B1
(45) **Date of Patent: *Sep. 11, 2001**

(54) UNIFORM COMPACTION OF ASPHALT CONCRETE

(76) Inventors: Edmund D. Hollon, 130 Frontier Dr., Douglas, WY (US) 82633; Blake D. Hollon, 1941 Park Dr., Douglas, WY (US) 82633

( * ) Notice: Subject to any disclaimer, the term of this patent is extended or adjusted under 35 U.S.C. 154(b) by 0 days.

This patent is subject to a terminal disclaimer.

(21) Appl. No.: 09/645,657

(22) Filed: Aug. 24, 2000

Related U.S. Application Data

(63) Continuation-in-part of application No. 08/908,551, filed on Aug. 8, 1997, now Pat. No. 6,113,309.
(60) Provisional application No. 60/024,241, filed on Aug. 20, 1996.

(51) Int. Cl.[7] ..... G01C 23/00
(52) U.S. Cl. ..... 404/84.2; 404/84.05; 404/104
(58) Field of Search ..... 404/84.05, 84.2, 404/84.1, 845, 96, 117, 104, 122, 123, 125, 126, 127, 132

(56) References Cited

U.S. PATENT DOCUMENTS 3,638,540 * 2/1972 Williams ..... 94/46
3,807,887 * 4/1974 Tate ..... 404/84
3,914,064 * 10/1975 Gurries ..... 404/84
3,966,345 * 6/1976 Kofel ..... 404/126
5,248,216 * 9/1993 Vural ..... 404/75
5,336,019 * 8/1994 Hollon et al. ..... 404/72
5,507,593 * 4/1996 Hollon et al. ..... 404/122
5,546,123 * 8/1996 Ikeda et al. ..... 348/119
5,838,277 * 11/1998 Loomis et al. ..... 342/357
5,851,086 * 12/1998 Kurasako ..... 404/94

FOREIGN PATENT DOCUMENTS

2061966 * 12/1970 (DE) ..... E01C/19/22
2119332 * 12/1972 (DE) ..... E01C/19/22

* cited by examiner

*Primary Examiner*—Thomas B. Will
*Assistant Examiner*—Raymond Addie
(74) *Attorney, Agent, or Firm*—Dean Edmundson

(57) ABSTRACT

An apparatus having a horizontal compacting roller and a side edge confinement roller or shoe for compacting an asphalt concrete lane. A sensor is on the carrier vehicle for sensing the position of a defined edge of the lane, and a control is provided for steering the carrier vehicle so that the horizontal roller and the edge confinement force roller or shoe follow the defined edge of the lane to provide uniform density.

6 Claims, 17 Drawing Sheets

POSSIBLE PATHS OF CONNECTION IN FIGURE 3:

MANUAL:

301B → 302 → 305

AUTOMATIC:

301A → 303A → 304

301C → 303C → 304

301B → 302 → 303B → 304

301A → 303C → 304

301B → 303C → 304

FIGURE 3A

PATHS OF CONNECTION IN FIGURE 4:

PAVER SYSTEM PATH:

401A+ 401B=402A; 402A → 403 → 404

TRANSMISSION PATH: (BETWEEN PAVER & EDGE ROLLER)

404 → 410 → 405

MANUAL DATA TRANSFER PATH: (BETWEEN PAVER & EDGE ROLLER)

403 → 409 → 406

EDGE ROLLER SYSTEM PATH:

401A+401B=402B; 402B+405 → 406; 406 → 407A & 407B

FIGURE 4A

UNIFORM COMPACTION OF ASPHALT CONCRETE

CROSS-REFERENCE TO RELATED APPLICATIONS

This application is a continuation-in-part of our application Ser. No. 08/908,551, filed Aug. 8, 1997, U.S. Pat. No. 6,113,309 which claims the benefit and priority of our earlier U.S. Provisional Application No. 60/024,241, filed Aug. 20, 1996.

FIELD OF THE INVENTION

This invention relates to compaction of asphalt concrete. More particularly, this invention relates to means for obtaining uniform compaction of asphalt concrete to reduce or prevent cracking of the asphalt concrete surface. In another aspect, this invention provides apparatus for use in obtaining uniform compaction of asphalt concrete.

BACKGROUND OF THE INVENTION

Our earlier patents, U.S. Pat. Nos. 5,336,019 and 5,507,593, describe method and apparatus for obtaining uniform compaction of asphalt concrete, which patents are incorporated herein by reference.

SUMMARY OF THE INVENTION

In accordance with the present invention, there are provided improved techniques and apparatus for controlling the functions of (1) positioning of the edge confinement roller, and (2) carrier vehicle steering.

Other features and advantages of the method and apparatus of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which:

FIG. 3A is a table showing the different possible pathways in FIG. 3 for controlling the steering of the compacting apparatus.

FIG. 4A is a table showing the different possible pathways in FIG. 4 for controlling steering, and the position of the edge confinement roller.

DETAILED DESCRIPTION OF THE INVENTION

Figure 1:
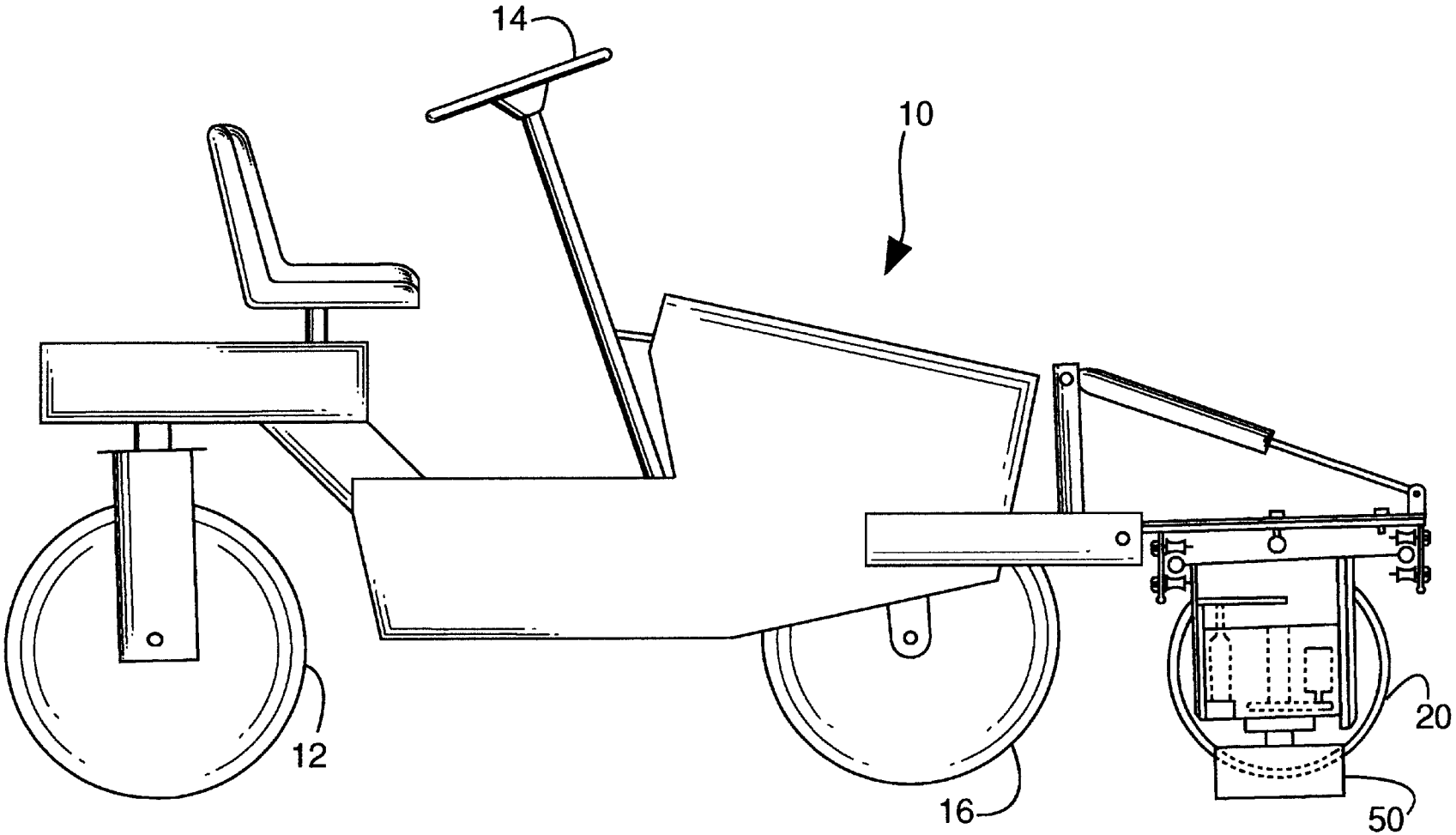
FIGURE 1 (PRIOR ART)
FIG. 1 is a side elevational view of asphalt concrete compacting apparatus as described in our prior patent, U.S. Pat. No. 5,507,593, incorporated herein by reference.

Our prior apparatus patent, U.S. Pat. No. 5,507,593, describes a machine which will perform the intended function of our prior patents. While working in this area with the controls as set out in the patents, we have developed improved ways to control the substantially vertical edge confinement roller 250 pressure and horizontal roller 220 down pressure and/or the elevation of horizontal roller 220 in relation to the elevation and the plane of the compacted surface of the entire width of the mat. The term "substantially vertical" refers to the edge confinement roller 250 being at an angle not greater than 45° away from a vertical line. In reality, this will put the finished compacted surface under the horizontal roller of the apparatus in the exact same plane as the compacted surface of the entire paver pass width. The apparatus horizontal roller 220 (not carrier rollers 212A, 212B & 213), mounted in its frame, is raised and lowered by machine screws or ball screws on each side of the vehicle. These screws are operated, either up or down, by hydraulic, pneumatic or electric motors. Other means may be used for raising or lowering horizontal roller 220. The mat is previously rolled by conventional asphalt rollers to within 8 to 12 inches, more or less, of the unconfined edge, this depending partially on the length of apparatus horizontal roller 220 which will be used to compact this side edge portion. Sensors 501 will read the elevation and the plane of the compacted surface, and will tell the hydraulic motors 408 on the screws to go up or down to match the compacted plane of apparatus horizontal roller 220 with the plane of the finished surface rolled by conventional rollers. In other words, the sensors will control the height of the bottom of horizontal roller 220, stopping when a predetermined down pressure is reached. Edge confinement roller 250 can have a load cell to tell the operator how much side force is being applied and the operator can adjust this side force to the amount of pressure needed to contain the edge so horizontal roller 220 is able to compact this 8 to 12 inches, more or less, to put it in the same plane as the plane of the balance of the paver pass width.

The sensors are also used to indicate to the operator when the 8 to 12 inches, more or less, of asphalt not previously rolled by conventional rollers has been sufficiently rolled to compact the given amount of hot mix asphalt into the desired given space. The sensors achieve this by indicating to the operator when both ends of roller 220 are at the same elevations as that portion of the previously compacted surface of asphalt. This will allow for the plane, of the surface of the previously compacted asphalt, to be extended, along the entire length of roller 220, to the edge of the asphalt at roller 250.

The use of sensors is the means for the operator to be able to know when there has been sufficient rolling done to extend and match the plane of the surface of the previously compacted asphalt onto the surface of the 8 to 12 inches, more or less, of uncompacted asphalt.

To relieve the machine operator of the task of steering the apparatus carrier, we have conceived of techniques for the carrier to steer itself. This would free up the operator to spend more time making sure the edge was being properly compacted to the desired density. There are many ways this automatic guidance system could be accomplished.

The first and rather simple self-steering system would simply have the carrier steer itself a given distance or a range of distances, 1" to 3" or 1' or 3', etc., from the finished edge that the apparatus side roller has or is finishing on the edge of the mat. In this mode, the operator selects the desired pressure, as measured by the load cell, to confine the edge to achieve the proper edge density.

The second, but somewhat more complicated, way of guiding the carrier would be for the steering system to follow a guidance marker for a sensor to follow. The marker would be laid by the asphalt paver. The modern asphalt pavers have heated extendable screeds so as to be able to lay the hot mix asphalt edge to a given line. On some machines this edge width adjustment is done manually and some have electronic capabilities to follow a string line. This edge width will hold a line within plus or minus one inch. For our purpose, plus or minus means nothing as we are going to finish the edge wherever it is laid. The paver lays down the amount of hot mix asphalt to do the width that the paver is set at. An attachment would be affixed to the paver screed that would place a marker in or on the partially compacted hot mix behind the paver screed or to the side of the paver onto the substrate that the hot mix is being placed on. This marker would be located in reference to the end or ends of the extendable screeds. These markers could be wires, paint, metal particles, or any other material that a sensor could follow.

Some of the sensors useful for following the different kinds of markers could be photoelectric, infrared, laser, fiber optics, magnetic and others. You could also use electronic cameras. It could be one of many kinds of electronic cameras. This camera could show a stationary pointer which would be kept over one of the different types of marker lines. This picture or image then would be shown on a remote screen or monitor. There it could be viewed by the operator and the operator could then keep the stationary pointer in line with the marker to manually steer the roller carrier on the desired course. This electronic camera system could also be used to automatically steer the roller carrier. This is all known technology.

From this you use an electric control that would steer left or right from less than ⅛ inch to a foot or more that a given point on the carrier would stay within these limits. This electronic sensor equipment is known technology. This system solves many of the problems that the operator has to make adjustments for. These problems come mostly from the temperature changes of the hot mix asphalt and the hot mix asphalt at the moment it is being compacted. In this system the apparatus is confining the given amount of hot mix asphalt in a given space and this will give you the density you desire. This allows a given amount of air void in this given space and this exactly what is meant by density.

It seemed logical to have all the apparatus powered with hydraulics. For the side shift of the apparatus roller, we change to air. The hydraulics worked, but the movements were rather harsh while the air movements are smoother.

The carrier 10 as shown in FIG. 1, hereinafter called carrier, including horizontal roller 20 and substantially vertical edge confinement roller 50, shown in the reference patents will work, but we have devised a better carrier. The rear roller 12 in the patents is steerable, but the powered roller 16 is not steerable. This makes it necessary to over-steer roller 12 to the right to make roller 16 move to the left. This makes apparatus horizontal roller 20 want to move radically first to the left and then radically to the right, which it can do, just to make one correction of the roller 16.

What we are doing in the present invention is to make the rollers at both ends of the carrier steerable. This allows the carrier to steer on the lead end of the carrier, regardless of the direction the carrier is traveling. This prevents this whiplash effect of the carrier. It makes it possible for the carrier, if steered on both ends at the same time and in the same direction, to move at an oblique (slant) angle with the longitudinal centerline of the carrier remaining parallel to the longitudinal edge of the asphalt mat while moving toward or away from the asphalt longitudinal edge. This basic apparatus is shown in FIG. 2A, FIG. 2B and FIG. 2C.

The rear roller 12, because it is steerable, is split and is actually two rollers (212A & 212B) mounted separately on a single common axle shaft. This makes them more like wide wheels. When you turn the steering wheel 14, when the carrier 10 is standing still, one half of the roller 12 is rotating in one direction and the other half is rotating in the opposite direction. When roller 16 of the previous machine becomes steerable, it will also have to be split (as shown in FIG. 2A, FIG. 2B, & FIG. 2C as 212A, 212B & 213). As a mater of weight and balance, it will be an advantage to separate the drum halves and mount them as separate wheels as shown. The widths and diameters may or may not be the same for each wheel. In addition, you can also then make it not only four-wheel steer, but also four-wheel drive. Under certain conditions, this is a great advantage.

Figure 2A:
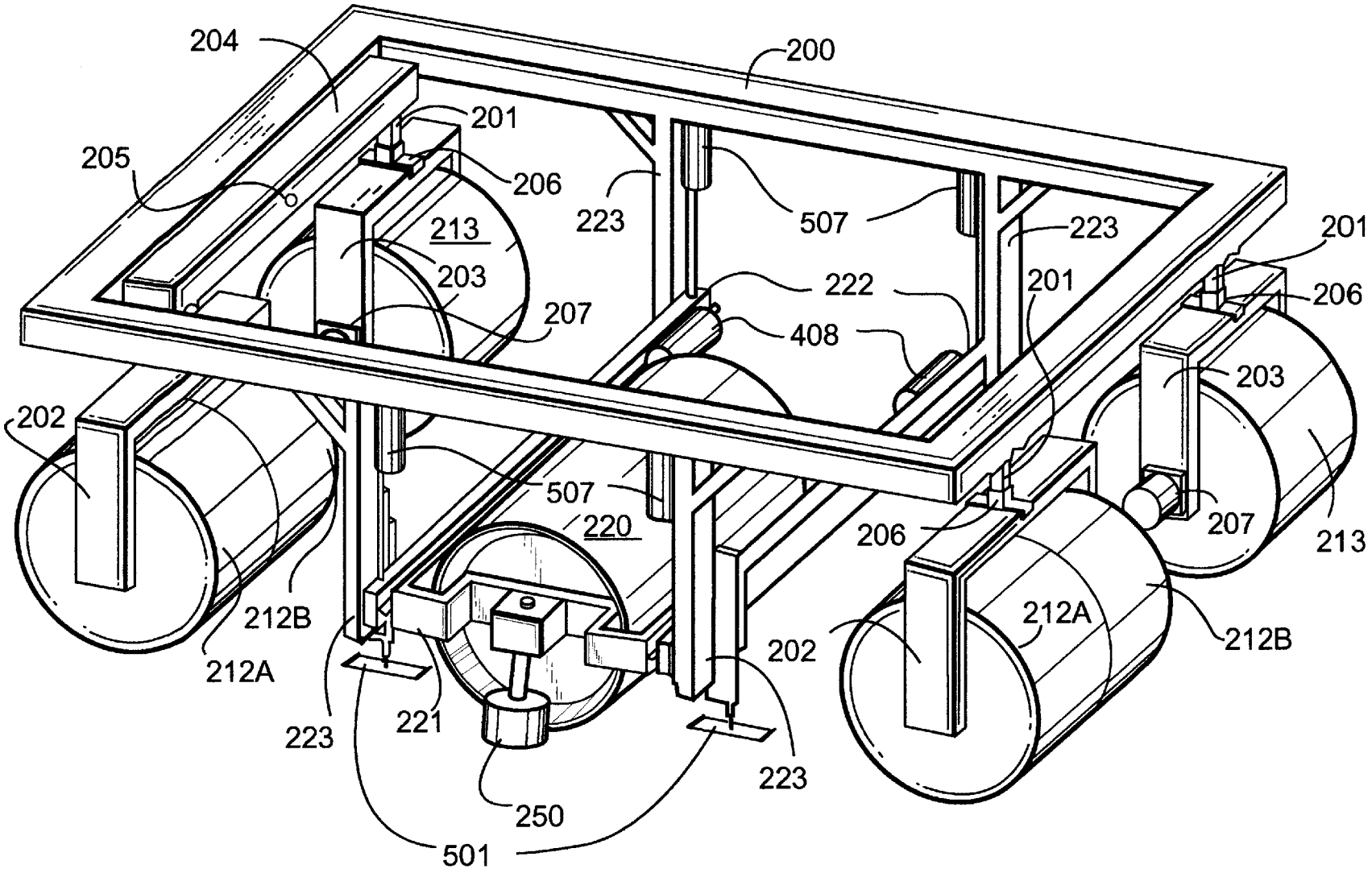
FIG. 2A is an isometric view of the roller apparatus employing principles of this invention, the view including rigid frame, compacting rollers and components.
Figure 2B:
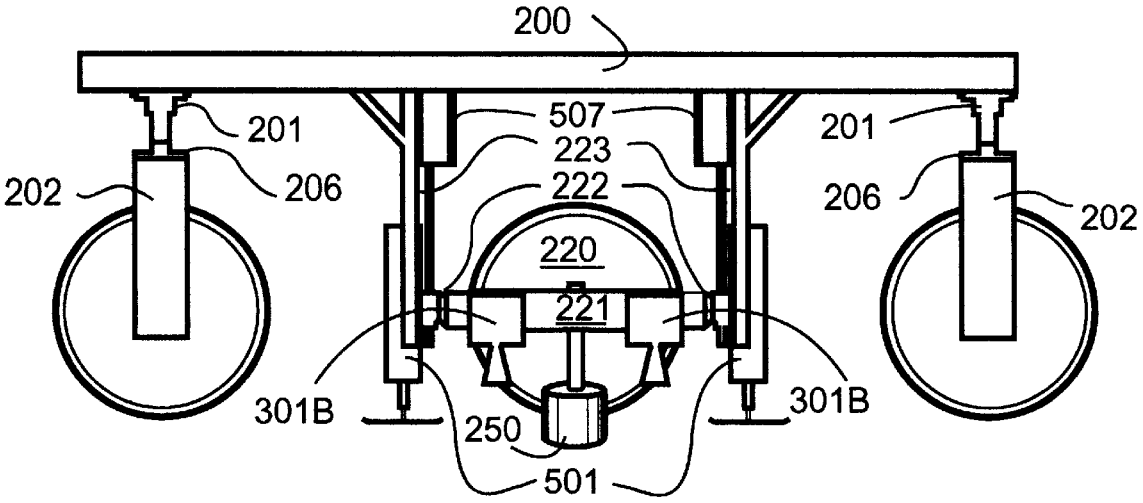
FIG. 2B is a side elevational view of the roller apparatus employing principles of this invention.
Figure 2C:
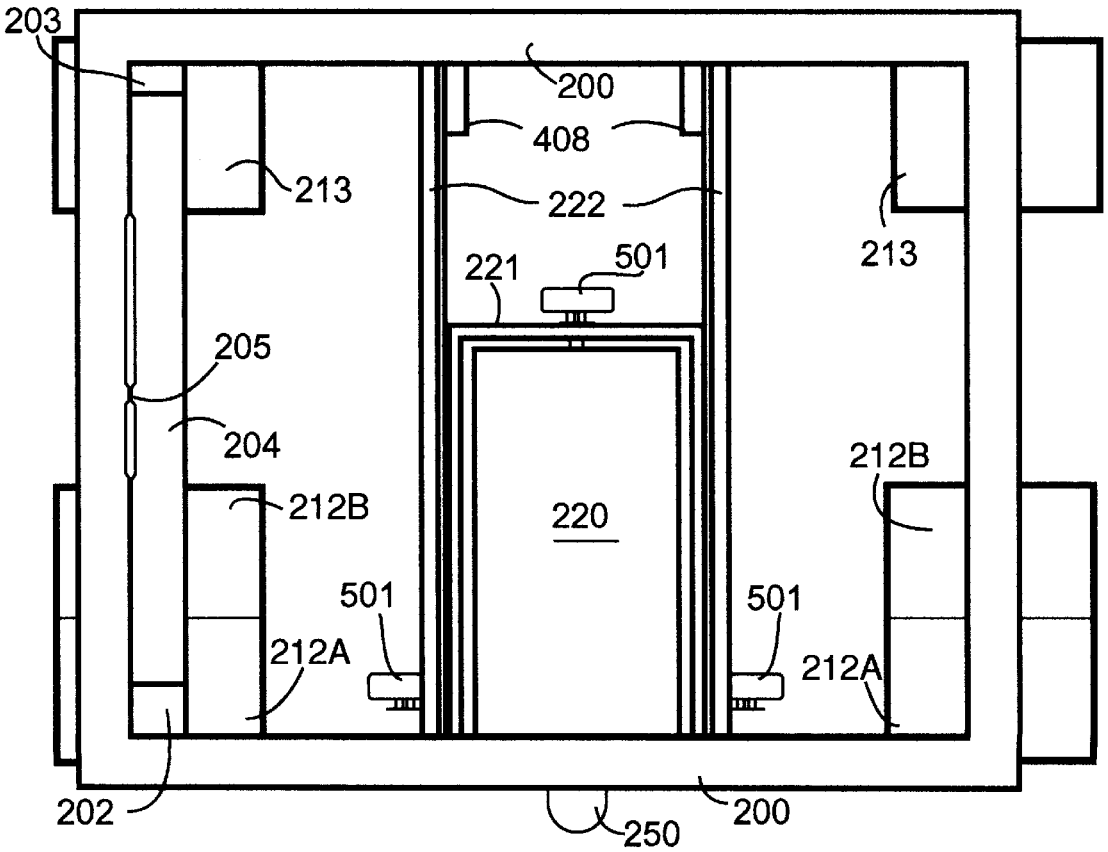
FIG. 2C is a top view of the roller apparatus employing principles of this invention.

In FIG. 2A, FIG. 2B & FIG. 2C, the components shown are identified as follows:

| | |
|---|---|
| Rigid Frame | 200 |
| Yoke Pivots | 201 |
| Yokes | 202 & 203 |
| Bolster | 204 |
| Boister Pin | 205 |
| Yoke Pins | 206 |
| Wheel Motors | 207 |
| Wheels | 212A & 212B |
| Wheels | 213 |
| Rorizontal Roller | 220 |
| Erame for Roller 220 | 221 |
| Side Shift Guide for Roller 220 | 222 |
| Vertical Guide for Roller 220 | 223 |
| Edge Confinement Roller | 250 |
| Side Shift Ball Screws w/motors for Roller 220 | 408 |
| Proximity Sensor Units | 501 |
| Vertical Ball Screws w/motorsfor Roller 220 | 508 |

The rigid frame 200 divides this machine into two distinct areas. Everything below this frame is the functional part of the machine. This part does what the basic intent of the machine is all about. That is to confine and compact the edge of the material, that the paver has laid down, to the same consistent desired density of the balance of the paver width.

Everything above this frame is just service for what is below the frame. This area has the mechanism to furnish the different power systems, such as hydraulic and pneumatic systems, electricity, the electronic control systems, the steering and guidance systems, sensors to monitor and control the functioning of the apparatus below this rigid frame 200. How all of these services are carried out is really superfluous as they can be done in many ways using known technology.

The apparatus roller 220 could remain on either end of the carrier, but if it were placed mid-ship between the front and rear rollers, as shown in FIG. 2A, FIG. 2B & FIG. 2C, it will have great advantages when driving the machine in either direction.

In controlling the weight and balance, to the best advantage, ballast tanks may be placed on either end of the carrier beyond the wheel rollers of the carrier. Also in between the steel rollers would be another logical location for ballast tanks as well as mid-ship with the apparatus. All these tanks could have more than one compartment to help shift weight from side to side and end to end to the best advantage.

The wheel rollers could also be so constructed to receive ballast fluids. All of this fluid ballast could be so plumbed that it could be drained, blown, pumped, or shifted in any other manner, from one area to another or discharged from the machine if conditions were to change. Such changes as grade, slope, gradation of the hot mix asphalt, grade of the asphalt binders, polymer modified binders used now or in the future or many other condition changes.

These wheels can very well be just bare metal as the regular asphalt rollers or they may have a solid tire of some material such as ultra-high molecular weight polyethylene or other plastic or rubber blends. These tires could also be of some other design such as pneumatic, semi-pneumatic, or filled with some material to stabilize the tire surface when under heat and/or stress. These are all known technologies.

In our two reference patents cited at the beginning of this disclosure, the problem of the longitudinal paver joint is covered in great detail. In the present disclosure we explain a new invention for a better apparatus to do this job in the same manner as our apparatus patent, but in a more effective and more foolproof manner. The two systems of having the machine steer itself lead us to another way of doing the same thing in a different manner.

Using the second system of self-steering, a machine employs a sensor to follow a guidance marker in or alongside a course of asphalt concrete. In our apparatus patent (U.S. Pat. No. 5,507,593), Col. 3, line 17 through line 35, we tell of two roller manufacturers who each have an edge confinement roller attached hard and fast to one of the two rollers on their machines. These edge confinement rollers are very similar to each other and function in the same manner. One brand is a Bomag and one is a Hamm.

The Bomag and Hamm edge confinement rollers do not include any means permitting lateral adjustment thereof. Further, neither the Bomag nor Hamm apparatus include means for adjusting the pressure exerted on the edge of an asphalt lift by their edge confinement roller.

It is a common understanding in the asphalt paving construction industry that the compaction along the unconfined edge of the mat rarely reaches 90% compaction when traditional compaction methods are used. This is the problem. Bomag says when their edge confinement roller was used compaction averaged 95%. Average is the key word here and this says the problem was not solved but changed. "Average" means that the compaction of the paver joint could be as low as ever in some areas and much higher in other areas. The low compaction areas will still ravel and break down as always, but the overcompacted areas (over 95%) will get wide thermal cracks. This undercompaction and overcompaction is covered in our method patent (U.S. Pat. No. 5,336,019), Col. 2, lines 15 through 36.

For airport projects, the Federal Aviation Administration now considers compacted pavement air voids so important that it will penalize contractors for too many voids (undercompaction) or too few voids (overcompaction).

By driving the compacting apparatus on an exact line, as our invention describes, you would not have these over and under edge density areas. Rather, you obtain truly uniform density of the compacted surface.

Here again, the electronic control as described in this invention will guide the roller from the guidance marker to within less than ⅛" steering either left or right. This could be either the fully automatic steering system or the system which makes it possible for an operator to guide the roller to within as little as ⅛" of the desired course. Here again, this system is confining the given amount of hot mix asphalt in a given space and this will give you the density you desire. This allows a given amount of air voids in this given space and this is exactly what is meant by desired density. The operator can make final fine adjustments to the vehicle guidance system, if need be, to correct for the desired density.

An edge confinement roller which is mounted to the carrier vehicle without any lateral adjustment capability in relation to the roller it is attached to, will be in the correct location on the asphalt edge, only because of this steering system provided by the present invention.

This edge confinement roller does not have to be in the same configuration or angle or size as either the Bomag or Hamm edge confinement roller. The edge confinement roller could have a water spray system if asphalt sticks to this roller. This edge confinement roller could be power driven rather than surface driven. It does not have to be a roller confinement edge but one of the other confinement types mentioned in our earlier patents (e.g., a shoe or plate).

There are other ways to make it possible for the above mentioned equipment to be self-steering in addition to those already outlined. In lieu of having a marker to follow, it would be possible to actually measure the amount of material that is in the last 12 inches, more or less, and determine where the exact edge of the compacted mat should be when this given amount of material is compacted in this area to reach the desired density.

The material in this last 12 inches, more or less, will not have a well defined edge or a well defined surface. This area would be immediately in front of the confinement edge compaction apparatus, would be surveyed or profiled with a laser beam, and these readings fed into an onboard computer which would be programmed so as to take these readings and extrapolate where this confinement edge apparatus should be to get the correct compaction desired. These laser readings could be taken as often as necessary. This could be for less than one second to thousands per second. This is existing off-the-shelf hardware, but it is a new use for this hardware.

Directly behind the edge confinement apparatus, if one desires, you could have a nuclear constant density gauge to fine tune the apparatus setting.

Figure 3:
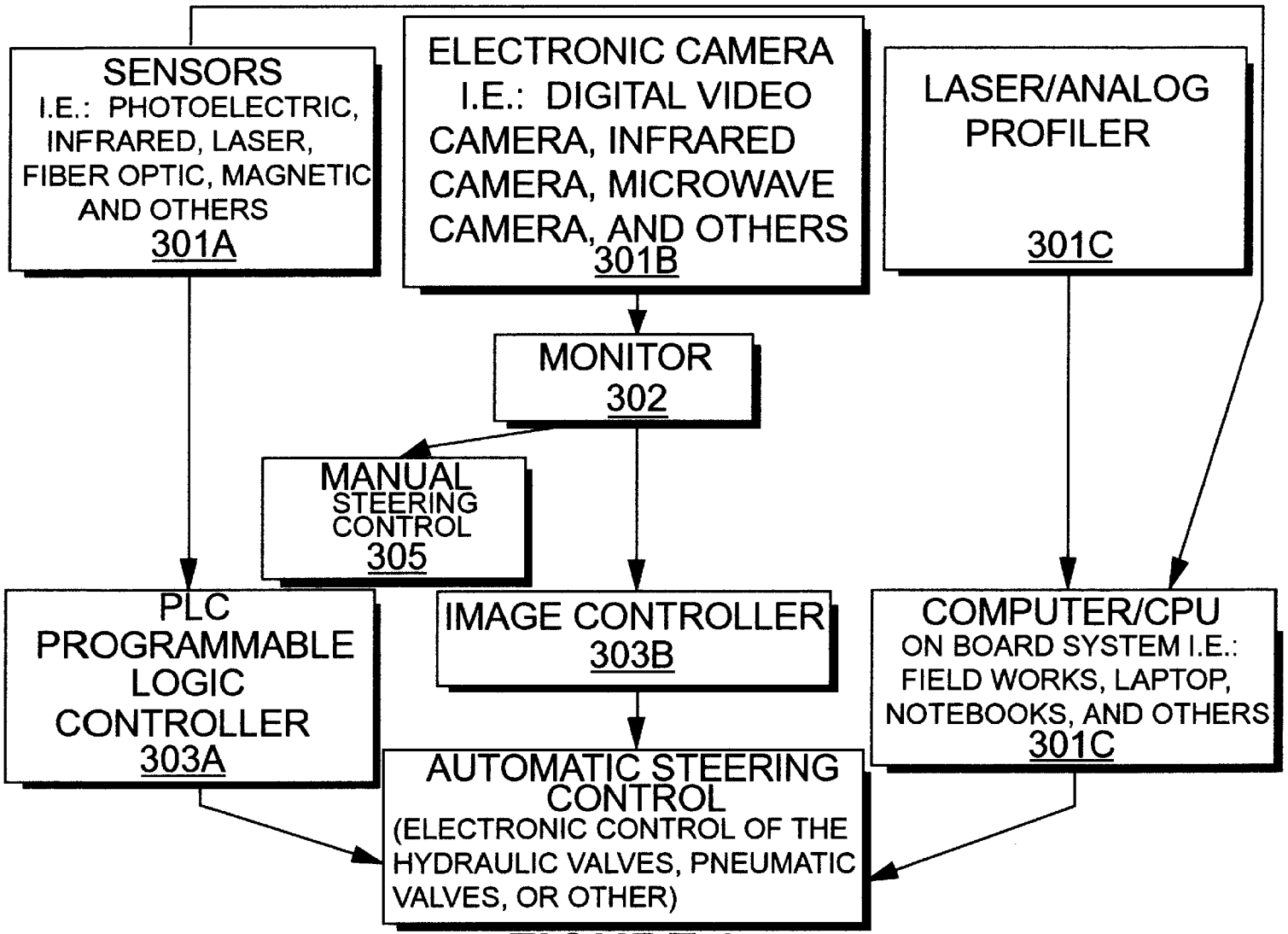
FIG. 3 is a schematic diagram illustrating different manners in which compacting apparatus of this invention can be steered. One manner involves using an electronic camera to observe a marker or line on or adjacent to the roadway, and the machine operator observes a monitor and manually steers the machine so that a marker on the monitor follows the line or marker on the ground. Other manners involve the use of sensors to detect a line or marker on the ground and automatically controls the steering of the machine. Yet another manner involves a laser/analog profiler which observes the edge profile of an uncompacted asphalt concrete layer, feeds the profile information to a computer, and uses the computer to control the steering of the machine.

FIG. 3 illustrates, in flow chart form, the different possible means of steering of the carrier vehicle. It shows the use of sensors 301A or cameras 301B, in conjunction with programmable logic controllers (PLC) 303A, such as the KV series, commercially available from Keyence Corporation of America; image controllers 303B, such as the CV series, commercially available from Keyence Corporation of America; or Computer/CPU 303C. These combinations are used to automatically control steering of the carrier by the electronic control of hydraulic or pneumatic valves, or to enhance manual steering.

Computer/CPU 303C can be full portable systems, such as Field Works PC's, notebooks, and others, or single chip CPU's programmed for specific applications.

Sensors 301A can be used with guidance markers located in reference to the end of or ends of the paver screed. These guidance markers can be the same ones used by the paver to position the end or ends of the paver screed. These guidance markers can be ones currently used for electronic paver screed control, such as wires. The markers could also be paint, metal particles, or any other material that a sensor could follow.

The sensors 301A themselves can be: photoelectric, such as the PK series, commercially available from Keyence Corporation of America; infrared, such as the Line Tracer II Robot (This unit has been commercially available at least as early as 1984) or Memocon Crawler (w/a parallel interface), both available from Stock Model Parts; laser, such as the LG series; and fiberoptic, such as the FS-L series, both commercially available from Keyence Corporation of America; magnetic, such as the BMF series; and ultrasonic, such as the BUS series, both commercially available from Balluff, Inc.

The Line Tracer II and Memocon Crawler, available from Stock Model Parts, are self-contained units. They both contain infrared sensor pick-ups, a central processing unit (CPU), and motors and wheels for mobility. For either unit to function, a line of contrasting color on the surface is needed, such as a dark line on a light colored surface or light colored line on a dark surface. Either unit is positioned over the line so as to have the infrared sensors placed on each side of the line. As the unit moves, each infrared sensor will signal the CPU upon detection of the line. The CPU will then make the appropriate course correction as to keep the line, be it straight or curved, between the two sensors. These units are built as toy robotics, but the steering mechanics can also be applied to our use.

Sensors 301A are connected to Programmable Logic Controller 303A or Computer/CPU 303C. PLC 303A or Computer/CPU 303C can be programmed so as to perform any output response to the input signals as desired. In the present application, we program PLC 502 as follows: Right limit Output On, in response to Right limit Input sensor trigger. Left limit Output On, in response to Left limit Input sensor trigger.

The outputs of the PLC 303A or Computer/CPU 303C are connected to electronic hydraulic or pneumatic valves, or other systems, to activate the appropriate solenoid for automatic steering control 304.

Electronic cameras 301B, such as existing digital, infrared, or microwave cameras monitor either a guidance marker or the edge of asphalt along the path of travel. The images are sent to Image controller 303B for processing with controller outputs connected to electronic hydraulic or pneumatic valves, or other systems, to activate the appropriate solenoid for automatic steering control 304. Optical measurement systems are presently available that accomplish this task, and new ones are being introduced, such as the Single-Camera Stereometric Laser Ranging System, which uses a laser beam in conjunction with an optical camera for distance measurement.

A much simpler use for electronic cameras would be as follows: Electronic camera 301B monitors either a guidance marker or the edge of asphalt along the path of travel. The image is displayed on monitor 302 with the carrier vehicle operator using the display to make corrections for manual steering control 305.

Figure 3B:
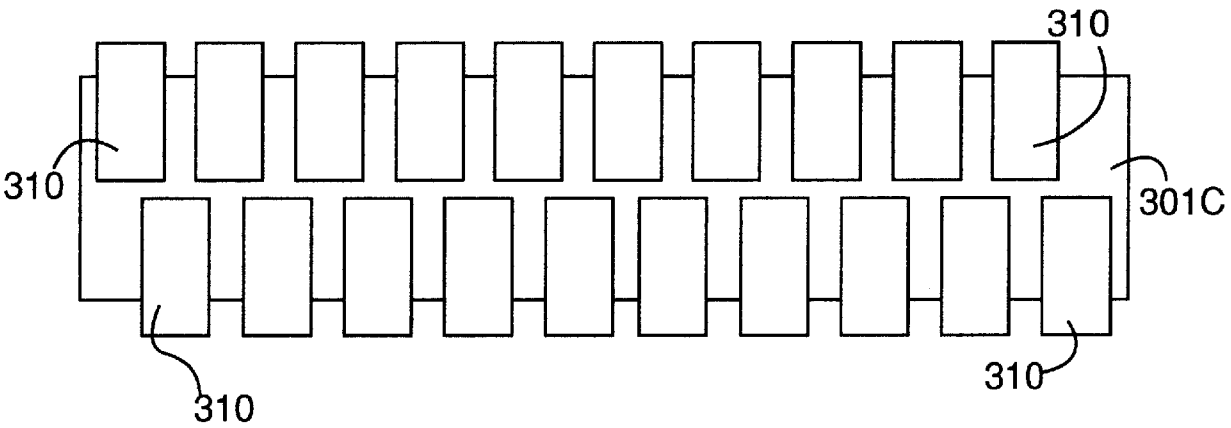
FIG. 3B is a bottom view of the laser/analog profiler.
Figure 3C:
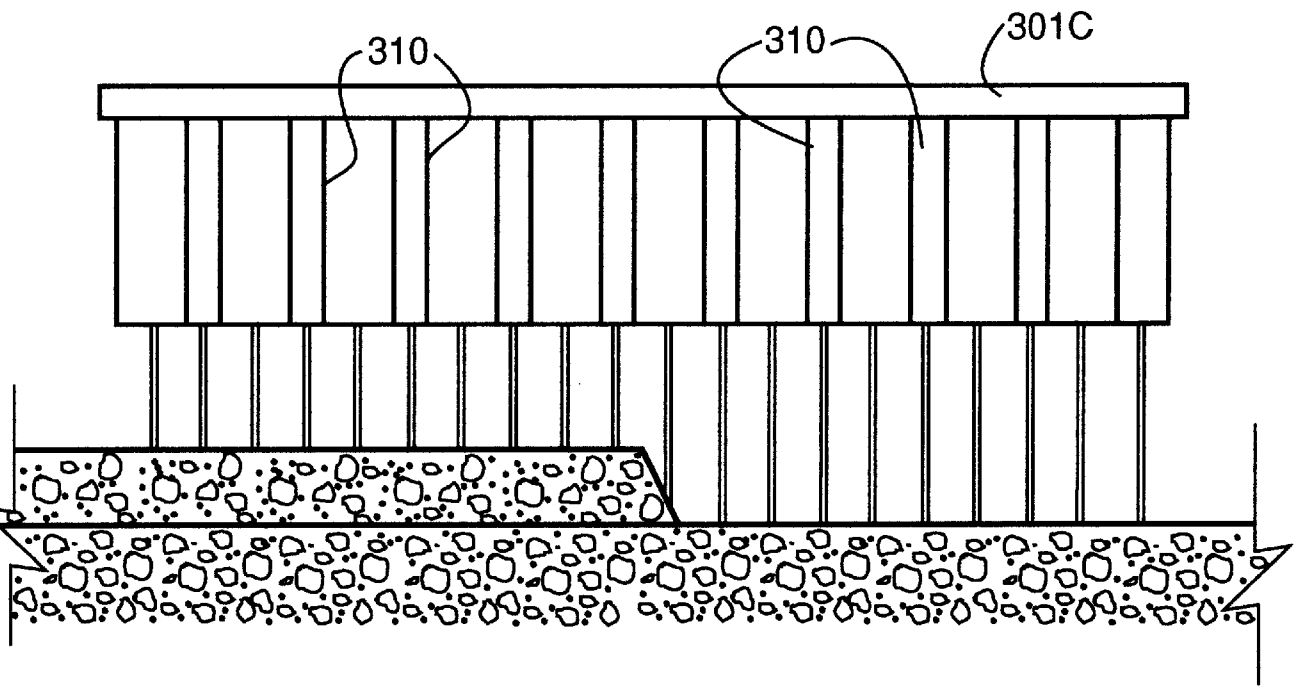
FIG. 3C is a front elevational view of the laser/analog profiler.

A Laser/Analog Profiler 301C, FIG. 3B & FIG. 3C, is positioned at a fixed point on the carrier vehicle and used to ascertain the edge of the asphalt pass. The profiler comprises an array of lasers. Each laser 310 measures the distance between itself and the asphalt surface directly below. Each distance measurement is plotted on Computer/CPU 303C. The plots are connected together to produce a profile. Computer/CPU 303C uses the information to determine the point at which the planarity of the profile changes. This point would indicate the defined edge of the asphalt pass.

Outputs from Computer/CPU 303C are connected to electronic hydraulic or pneumatic valves, or other systems, to activate the appropriate solenoid for automatic steering control 304. These outputs would be programmed so as to steer the carrier vehicle in order to keep the change in planarity in the center of the profile.

Figure 4:
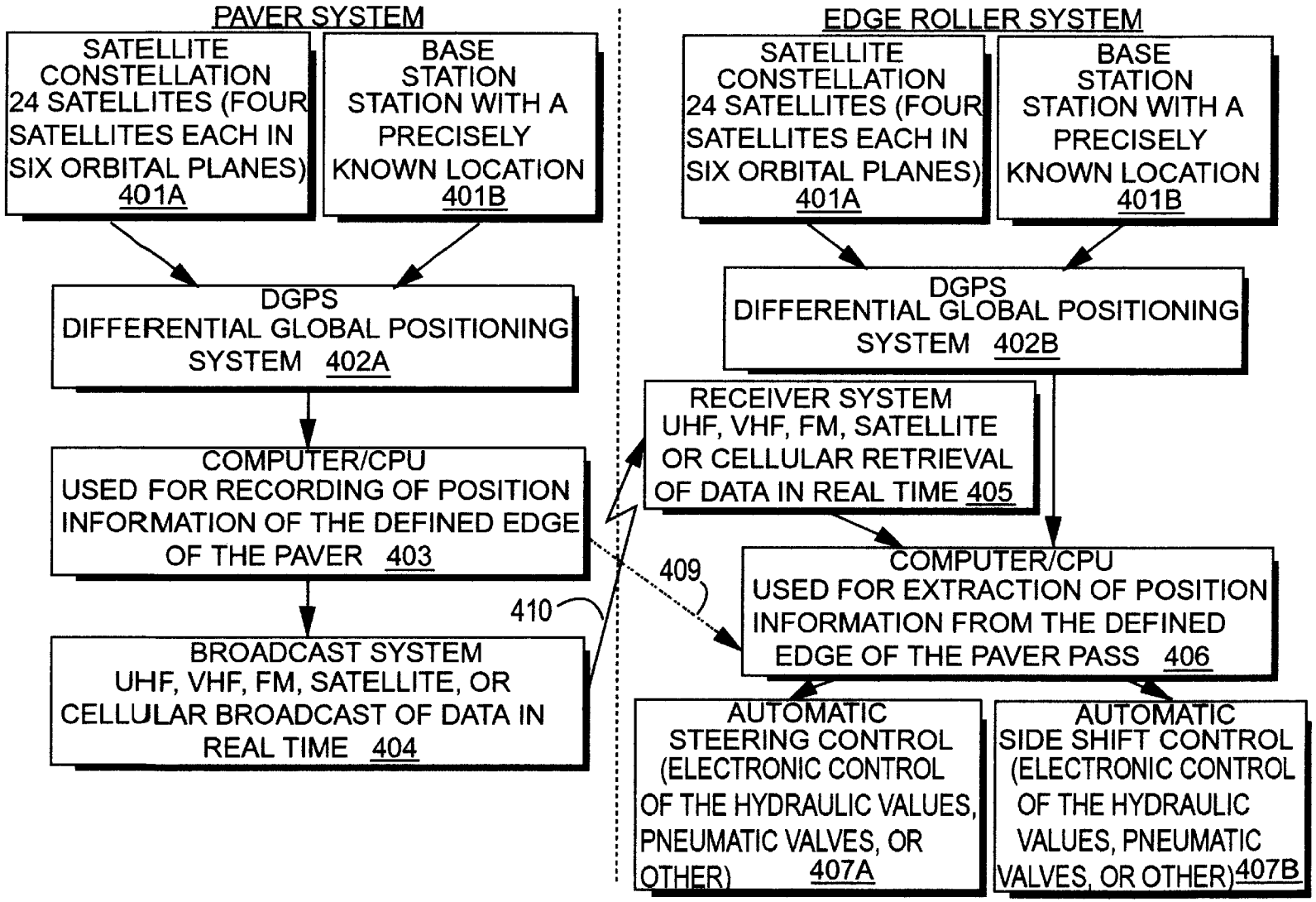
FIG. 4 is a schematic illustration of a control system using GPS (Global Positioning System) for steering the compacting apparatus of this invention and for controlling the position of the edge confinement roller (or other confinement device) when compacting asphalt concrete.

FIG. 4 illustrates, in flowchart form, another possible means of steering of the carrier vehicle. This system incorporates the Global Positioning System (GPS) for automatic steering control 407A and automatic side shift control 407B.

The principles of GPS are fairly simple to understand. The United States Department of Defense developed and launched a constellation of 24 GPS satellites (four satellites each in six orbital planes). This constellation was strategically placed around the earth in order to give each area of the earth's surface constant coverage by at least four different satellites. The satellites circle the earth approximately every 12 hours, with each one transmitting its own unique signal down to the GPS receiver. The receivers accept signals from as many satellites as possible, while the numbers vary depending on the receiver's location on earth. The GPS receiver, by using the signals from each satellite, can determine the distance to it.

This information is used to determine the receiver's location on earth in relation to the known points of the identified satellites. Two-dimensional positions (longitude and latitude) use the signals from three satellites, and three-dimensional positions (longitude, latitude and elevation) require the use of four positions. In fact, some of the more advanced GPS units can determine a location within one centimeter's margin of error.

Moving and precision applications, such as vehicle guidance, requires another form of GPS called Differential GPS (DGPS). This system configuration requires a base station with a precisely known location in relation to the edge of the asphalt mat to be compacted. The base station calculates its GPS position from the satellite signals, compares it with its known position, and generates correction data.

The Satellite Constellation 401A, when used with a Base Station 401B, results in a Differential Global Positioning System 402A and 402B, such as the 7400Dsi, commercially available from Trimble Navigation Limited.

DGPS receiver 402A is positioned on the paver in a location as to indicate the intended finished edge of the asphalt mat which the paver is laying. Receiver 402A is interfaced with onboard Computer/CPU 403. Computer/CPU 403 contains software, such as Pathfinder Office™, commercially available from Trimble Navigation Limited, for data collection and recording the defined edge of the paver path of this intended mat edge.

The storage and transfer of this defined edge information can be handled in multiple ways. First, this data could be stored to a removable media, such as magnetic floppy disk, optical compact disk, or any other data storage device. This device is then removed from the paver's Computer/CPU 403 and transferred by hand, along physical path 409 to edge roller's Computer/CPU 406.

As secondary means, and more preferred, of getting this data from the paver to the edge roller is to change the digital defined edge information to a media which can be broadcast (via broadcast 410, be it UHF, VHF, FM, satellite, or cellular) using Broadcast System 404, in real time to Receiver System 405, located on the Asphalt Edge Roller. This data is then transferred to Computer/CPU 406 on the Asphalt Edge Roller.

Regardless of the means of transfer, the defined edge of the paver's intended finished edge, is now stored in the Asphalt Edge Roller's onboard computer 406.

DGPS receiver 402B is positioned on the Asphalt Edge Roller in a location as to indicate the confinement edge face of edge confinement roller 250 and is interfaced with an onboard Computer/CPU 406. Computer/CPU 406 is programmed so as to correlate the data received from its onboard DGPS receiver 402B with that of the paver's defined edge, and align or position the Asphalt Edge Roller to that of the paver.

We now have the means of controlling two (2) functions on the asphalt edge roller.

First, outputs from Computer/CPU 406 are connected to electronic hydraulic or pneumatic valves, or other systems, to activate the appropriate solenoid for automatic steering control 407A. These outputs would be programmed so as to steer the asphalt edge roller in order to maintain a certain distance or range of distance from this edge. This same automatic steering system can be used on rollers having a fixed edge confinement apparatus similar to the Hamm or Bomag systems.

Figure 4B:
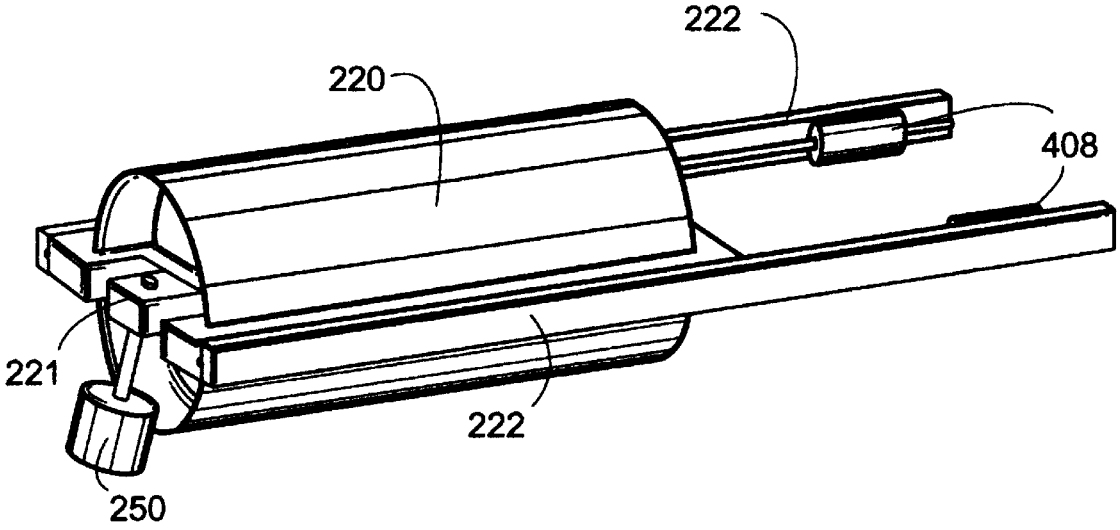
FIG. 4B is an isometric view of the mechanics for automatic side shift control of horizontal roller 220.
Figure 4C:
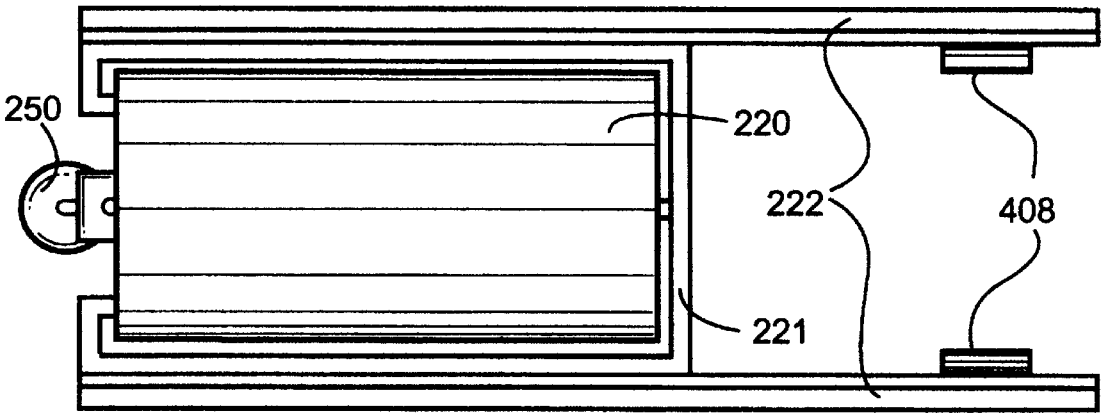
FIG. 4C is a top view of the mechanics for automatic side shift control of horizontal roller 220.

Second, in FIG. 4B & FIG. 4C, outputs from Computer/CPU 406 are connected to electronic hydraulic or pneumatic valves, or other systems, to activate the appropriate solenoid for automatic side shift control 407B. These activations will operate linear actuators (such as rotating ball screw motors 408) so as to shift horizontal roller 220 along guides 222. These outputs will be programmed so as to position edge confinement roller 250 to travel along the intended finished edge (i.e. defined edge). This action will give horizontal roller 220 its automatic side shift capability.

This GPS and DGPS based steering mechanism as described herein could be used on other equipment applications, such as buses, road equipment, transportation vehicles, trucks, golf carts, or other types of equipment.

Figure 5:
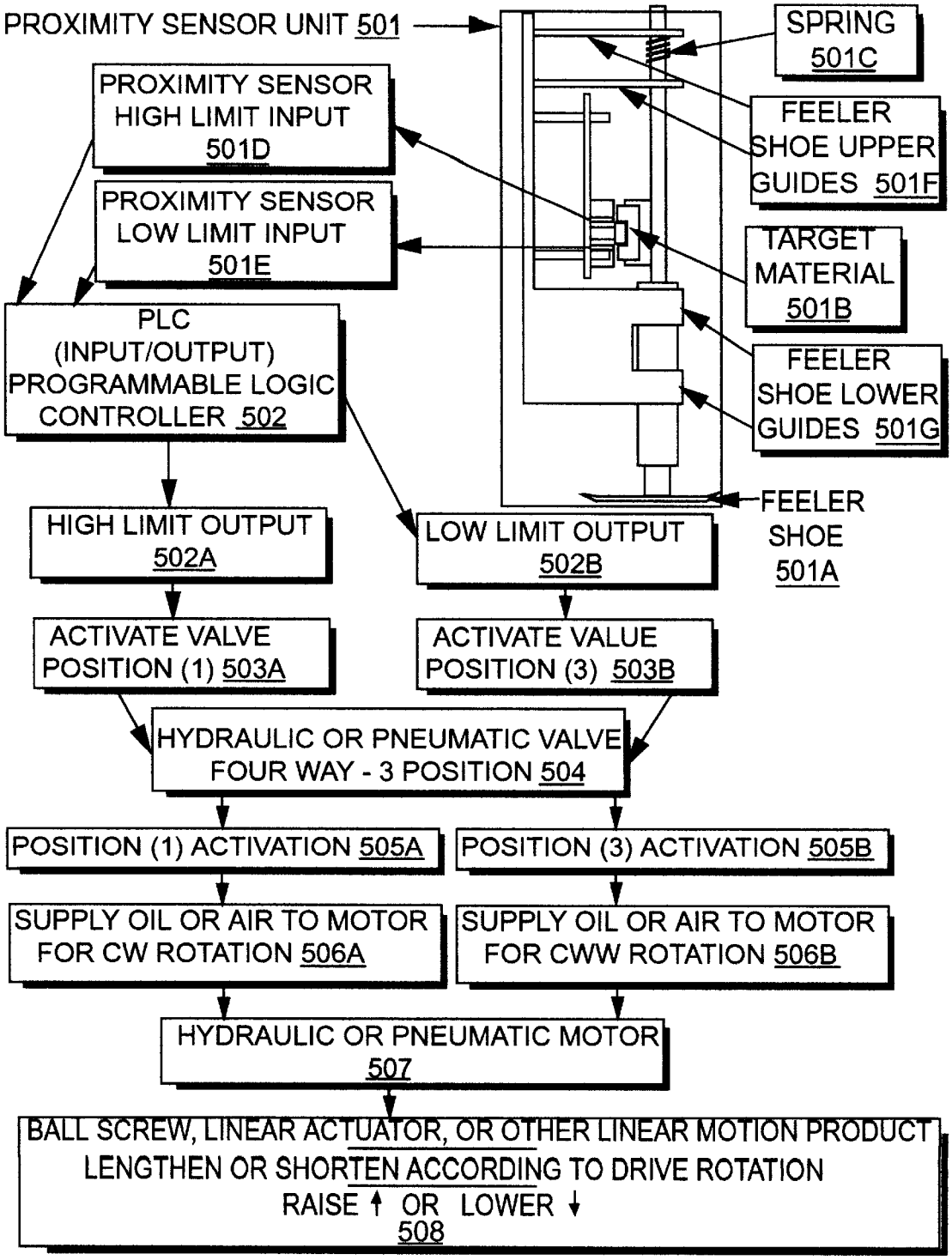
FIG. 5 is a schematic illustration showing the operation of the proximity sensor units 501.
Figure 5A:
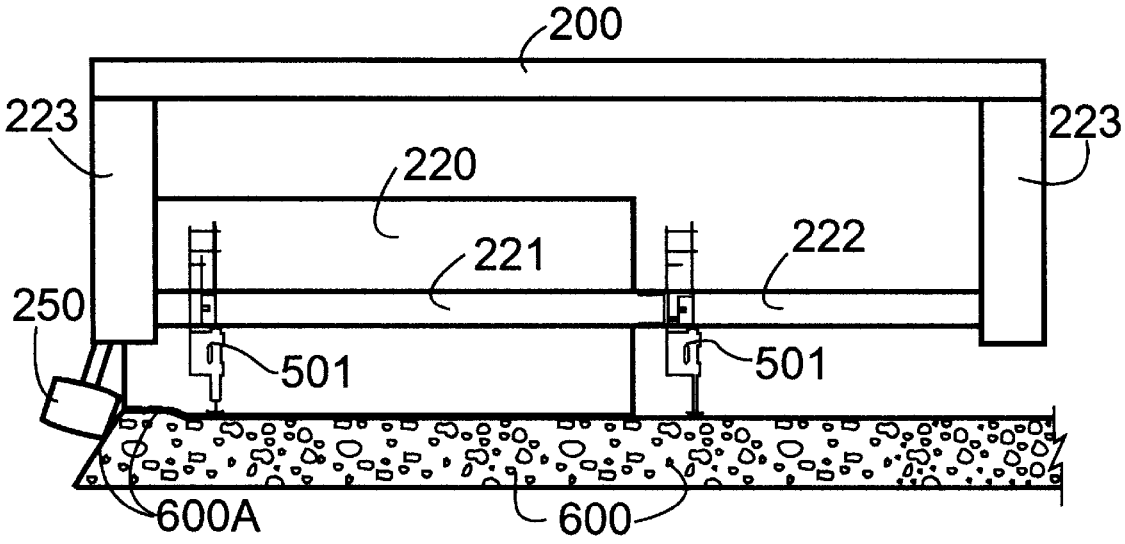
FIG. 5A illustrates the location and function of proximity sensors 501. This view shows the portion of asphalt concrete 600 not yet rolled by horizontal roller 220 and edge confinement roller 250.
Figure 5B:
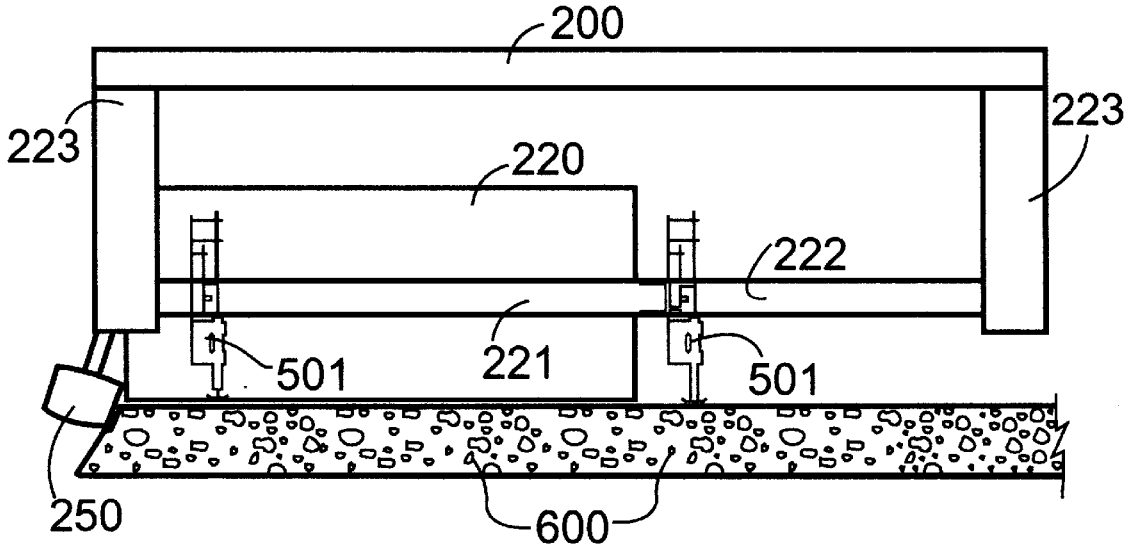
FIG. 5B illustrates the location and function of proximity sensors 501. This view shows the completed compaction of asphalt concrete 600 after rolling by horizontal roller 220 and edge confinement roller 250.

FIG. 5 illustrates, in flowchart form, the operations performed for horizontal placement of horizontal roller 220 of the roller apparatus. In FIG. 5A & FIG. 5B, Proximity sensing units 501 (positioned near each end of horizontal roller 220) are used to monitor the position of the existing rolled asphalt concrete 600. There are three sensor units 501 (see FIG. 2C). The sensor unit 501 which is positioned in line with the axle at the end of horizontal roller 220 is used for either direction of travel. As for the other two sensor units 501, only the unit on the leading side of horizontal roller 220 is used, depending upon the direction of travel. The existing asphalt concrete 600 is that portion of the asphalt pass that has been finish compacted to within 8" to 12", more or less, of the non-contained edge.

Unit 501 comprises: a feeler shoe 501A, target material 501B, spring loading for unit 501C, proximity sensor for high limit 501D, proximity sensor for low limit 501E, feeler shoe upper guides 501F, and feeler shoe lower guides 501G. Parts 501A (feeler shoe), 501B (target material w/holder), and 501C (spring loaded upper shaft) are all parts of a single component. This component is capable of moving up or down in relation to the rest of unit 501. Proximity sensors 501D and 501E are mounted on the stationary portion of unit 501, as are upper guides 501F, and lower guides 501G. 501F & 501G are used to guide the movable portion of unit 501. Feeler shoe 501A rides along the existing rolled portion of asphalt concrete 600. Spring 501C is used to apply down pressure between the movable portion of unit 501 and upper guide 501F. This insures continuous contact of feeler shoe 501A with asphalt concrete 600.

Proximity sensors 501D and 501E are spaced to allow target material 501B to be located within their gap. Target material 501B is preferably a ferrous material. As feeler shoe 501A rides up and down along the existing asphalt concrete 600 upper surface, target material 501B moves up and down in relationship to stationary sensors 501D and 501E. When the target travels toward the high-frequency magnetic fields generated by the sensing coils in the sensors, an induction current (eddy current) is created on the target which increases the impedance of the coil and finally causes oscillation to stop, thereby signaling target detection.

Proximity sensors 501D and 501E are connected to Programmable Logic Controller (PLC) 502. PLC 502 can be programmed so as to perform any output response to the input signals as is desired. In the present application, PLC 502 will be programmed as follows: High limit Output 502A ON, in response to High limit Input 501D trigger. Low limit Output 502B ON, in response to Low limit Input 501E trigger.

A High limit Output 502A will activate position (1) solenoid 503A on four way—3 position valve 504. A Low limit Output 502B will activate position (3) solenoid 503B on four way—3 position valve 504.

There are additional sensor systems other than proximity sensors connected with a programmable logic controller (PLC) that can be used to provide the high and low limit information for activation of solenoids 503A or 503B. Examples of other systems are: self-contained Laser Gauge Sensor with built-in control outputs; or a High Accuracy Positioning sensor for Hi/Lo tolerance detection with a single controller. These and other possible types of systems exist and are in current use. Of course, other sensing systems may be developed in the future which would also be useful in the present invention for sensing the position of the asphalt concrete and activating the hydraulic or pneumatic systems for controlling the position of the ends of the compacting roller(s).

With a position (1) activation 505A of valve 504, supply fluid (oil or air) 506A will be fed to motors 507 for clockwise rotation. With a position (3) activation 505B of valve 504, supply (oil or air) 506B will be fed to motors 507 for counterclockwise rotation.

Dependent on the direction of rotation of motors 507, the linear motion apparatus 508 (ball screw, linear actuator, or other) will lengthen or shorten. This will raise or lower a respective end of horizontal roller 220. This will assure that horizontal roller 220 will remain in the same plane as the existing rolled asphalt concrete 600.

FIG. 5A & FIG. 5B illustrate a before & after view, respectively, of the compaction of asphalt concrete 600. In FIG. 5A, sensing units 501, near each end of horizontal roller 220, monitor the position of existing rolled asphalt concrete 600. The portion 600A of asphalt concrete 600 not yet rolled will consist of the substantially vertical edge surface and 8" to 12", more or less, of the adjacent horizontal surface. In FIG. 5B, the positioning of horizontal roller 220, by means of sensors 501, allows for the unrolled horizontal portion of asphalt concrete 600 (which is 600A shown in Fig. 5A), to be rolled and compacted as to maintain the same planarity as the balance of asphalt concrete 600. The compaction of the substantially vertical edge surface is achieved by means of the automatic side shift control of edge confinement roller 250 horizontally.

Any of the above mentioned automatic steering systems could also be used in conjunction with conventional rollers having a fixed edge confinement apparatus similar to the Hamm or Bomag devices previously discussed. By use of automatic steering of the carrier vehicle, the fixed edge confinement apparatus would then have the capability to achieve and maintain the desired density. By doing so, these fixed edge confinement apparatus rollers will then become an edge force which is longitudinally mobile and horizontally translatable. This will make these fixed edge confinement apparatus rollers suitable for use in accordance with our method patent, U.S. Pat. No. 5,336,019.

The carrier vehicle can have many different configurations. The carrier vehicle can be configured so that the horizontal roller, with the edge confinement roller, can be part of the carrier vehicle suspension system. FIGS. 6–11 show one possible example of this type of roller configuration.

In FIGS. 6–11 there is illustrated compaction roller apparatus 700 which is also useful in the techniques of the present invention. The apparatus comprises a frame 702 carrying two cylindrical compacting rollers 704 and 706 on horizontal axes at opposite ends of the frame. These rollers are independently steerable. Roller 704 is supported in yoke 703 and roller 706 is supported in yoke 701. Each yoke is able to pivot about a vertical yoke pin (identified as yoke pin 703A for yoke 703 and yoke pin 701A for yoke 701). Operator seats 710 and 711 are carried on the upper surface of the frame.

Figure 8:
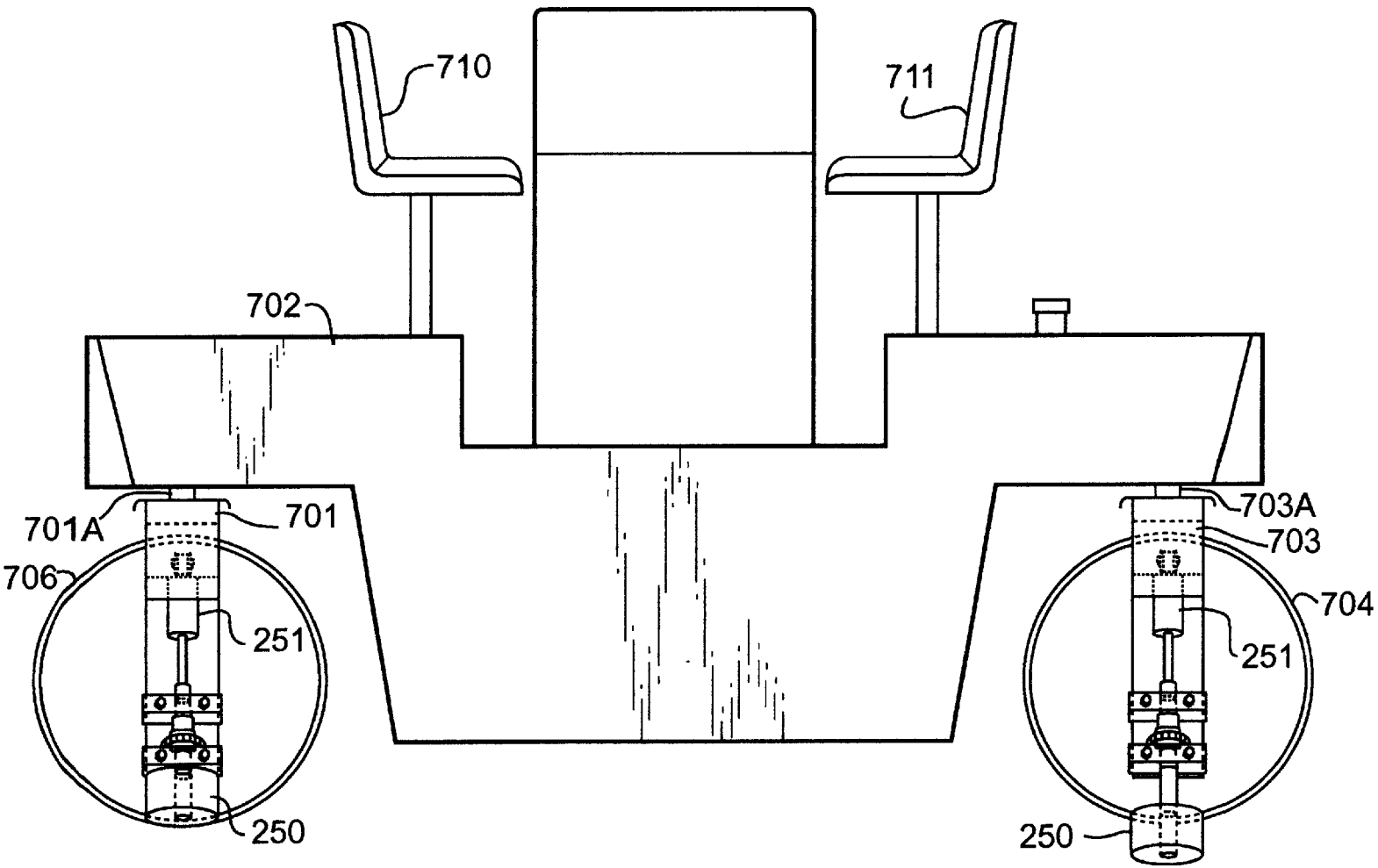
FIG. 8 is a side elevational view of the apparatus shown in FIGS. 6 and 7.
Figure 9:
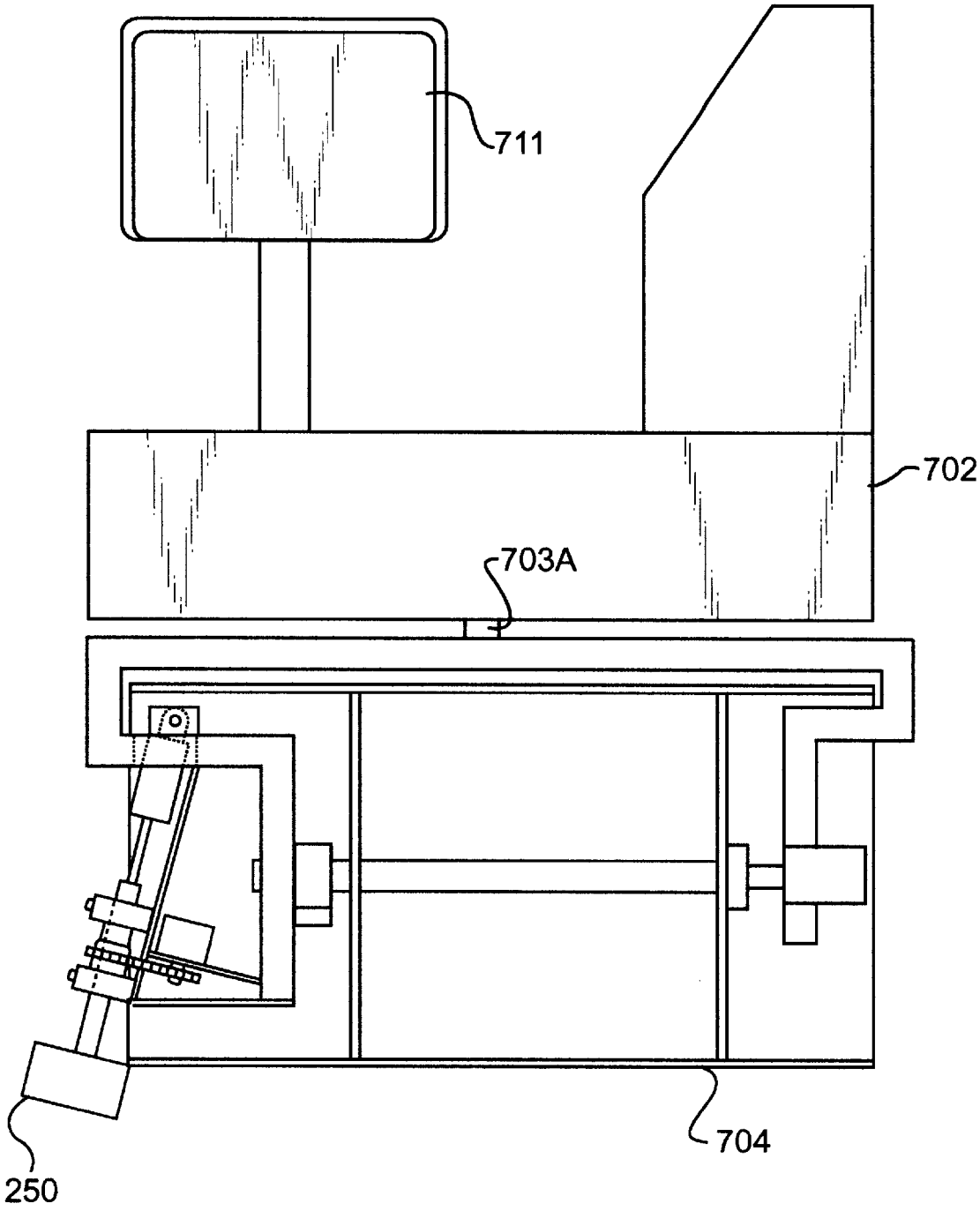
FIG. 9 is a front elevational view, partially cut-away, of the apparatus of FIGS. 6 and 7.
Figure 10:
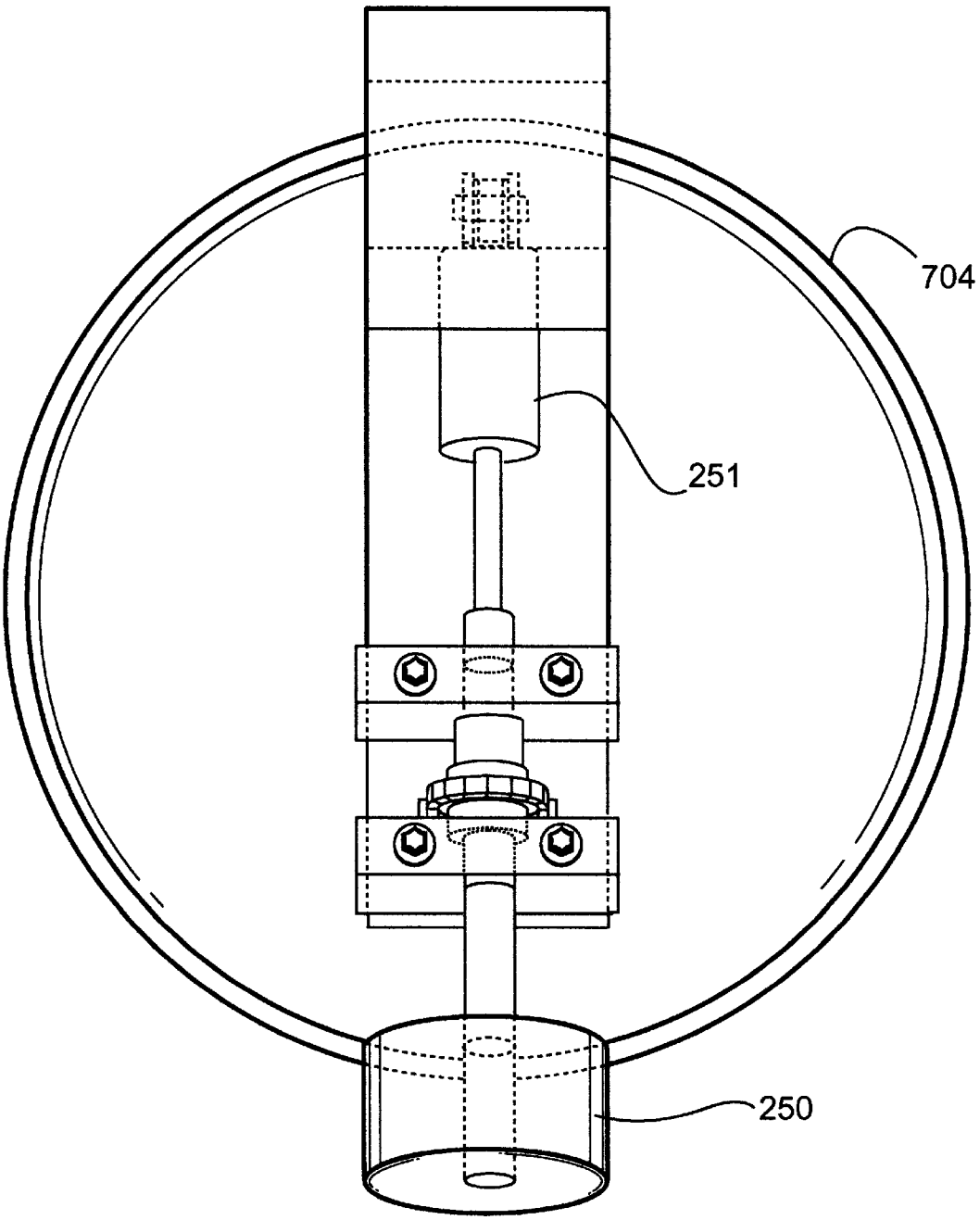
FIG. 10 is a side elevational view showing the manner in which the side edge confinement roller is supported on one end of a large compacting roller in the apparatus of FIGS. 6 and 7.

One end of each horizontal compacting roller 704 and 706 carries a side edge confinement roller 250, as illustrated. Each roller 250 is independently movable in a vertical direction by means of hydraulic or pneumatic cylinder or linear actuator 251. In FIG. 8 (side elevational view of the apparatus) one of the rollers 250 is in a fully raised position while the other roller 250 is in its lowered position.

Figure 6:
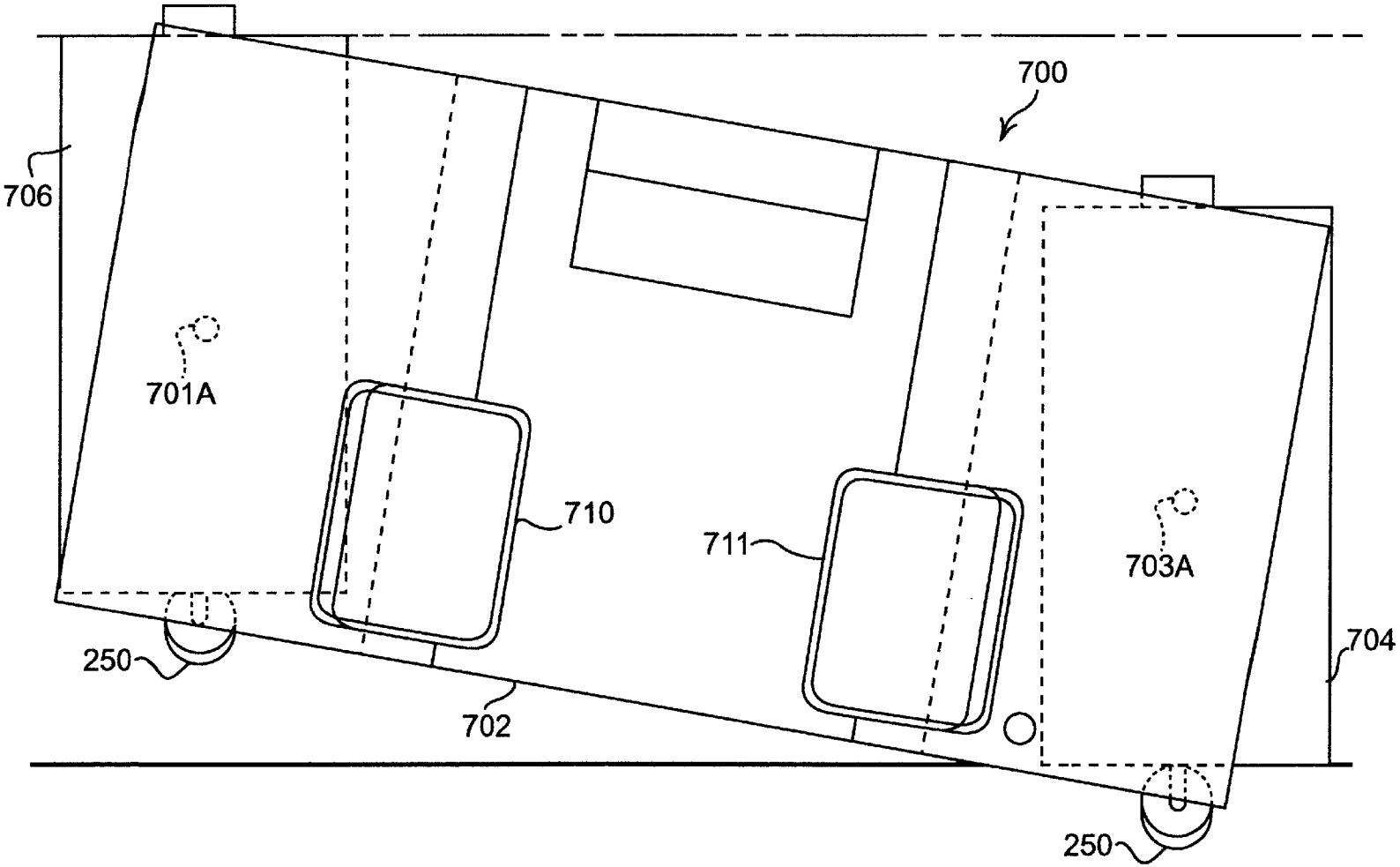
FIG. 6 is a top view of additional apparatus of the invention for obtaining uniform compaction of aspahlt concrete, the apparatus including front and rear compacting rollers which can be steered independently.

When the apparatus 700 is used in the manner shown in FIG. 6, the horizontal rollers 704 and 706 are parallel to each other but are turned slightly to the left (relative to the longitudinal centerline of the frame 702) such that these rollers are slightly offset from one another while compacting asphalt concrete. In this operating configuration, one of the side edge confinement rollers 250 must be in its raised position (as shown in FIG. 8).

The apparatus 700 shown in FIGS. 6–11 can include the automatic steering controls discussed above in connection with the other apparatus and methods of this invention.

Figure 7:
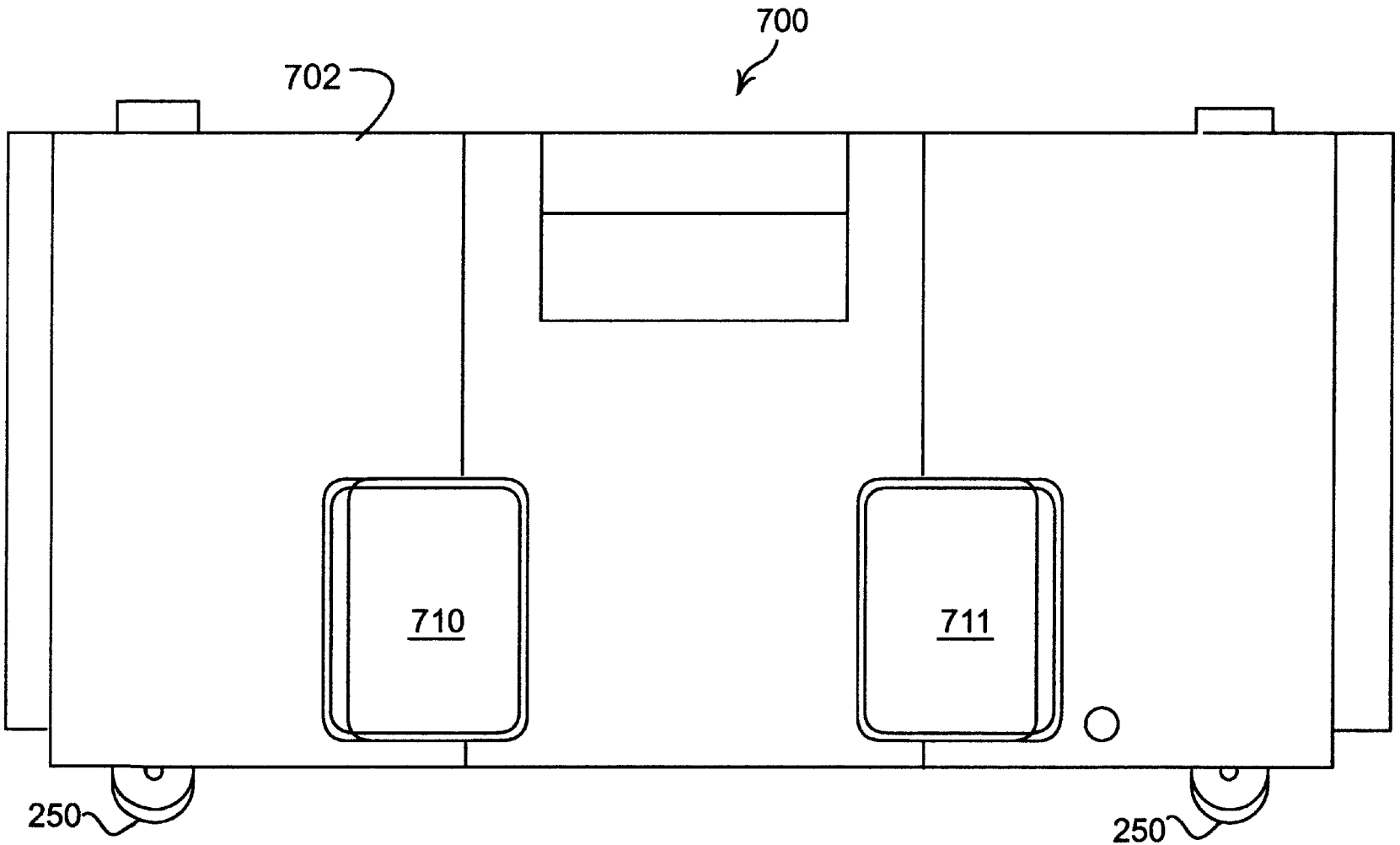
FIG. 7 is another top view of the apparatus of FIG. 6.
Figure 11:
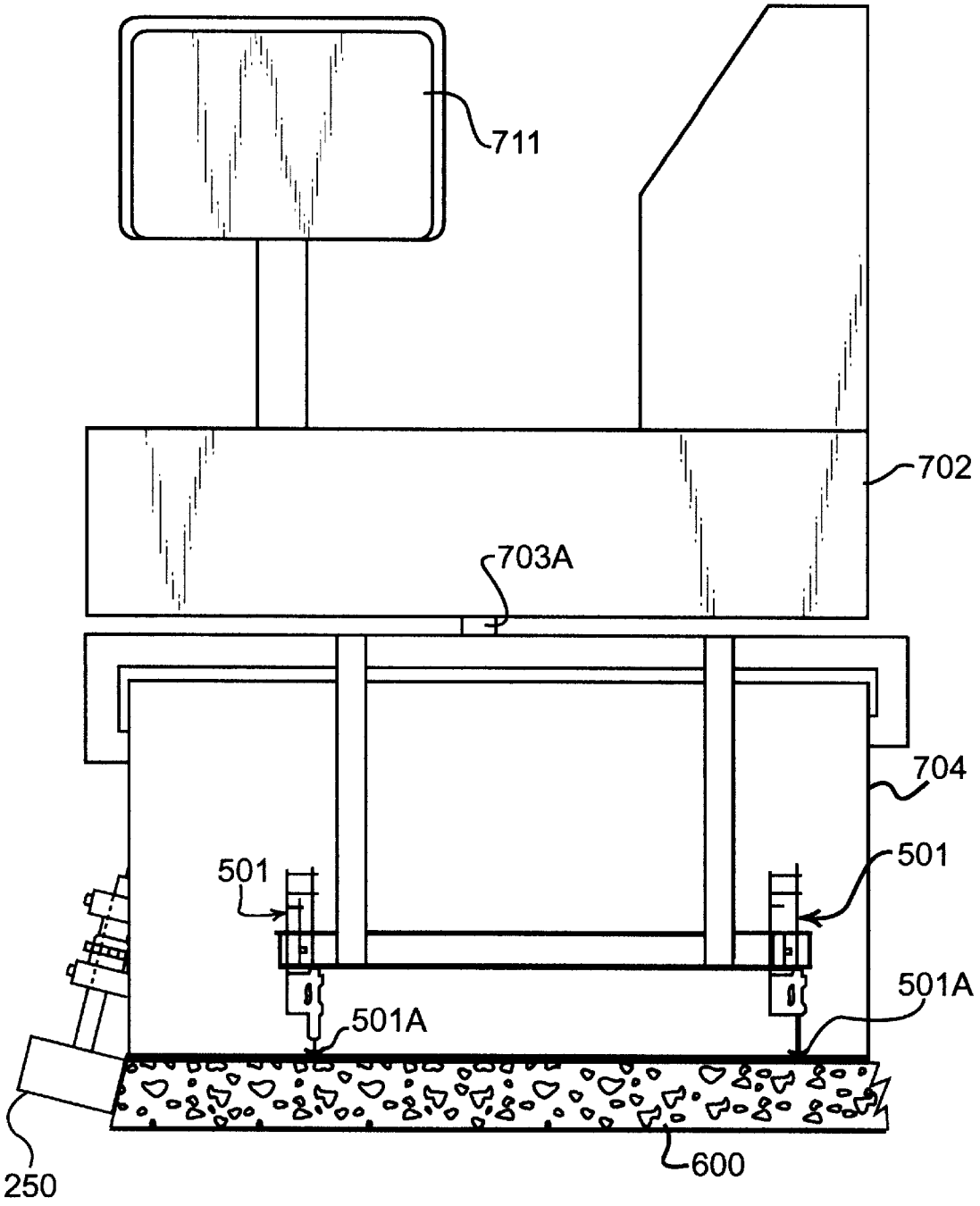
FIG. 11 is a front elevational view of the apparatus of FIGS. 6, 7 & 8 with proximity sensing units 501 being provided forwardly of compacting roller 704 to monitor the position and planarity of the asphalt concrete being rolled.

FIG. 11 is a front elevational view of the apparatus of FIGS. 6, 7 & 8 to which has been added proximity sensors 501 forwardly of compacting roller 704. The proximity sensors monitor the position and planarity of the asphalt concrete 600. Similar proximity sensors are also preferably provided on the opposite end of the compacting apparatus for use when the apparatus is driven in the opposite direction. Any of the various types of proximity sensors previously described herein may be used.

If the edge confinement end of roller 704 or 706 is riding up on the 8 to 12 inches, more or less, of uncompacted asphalt, due to insufficient compaction, there would be a gap between the roller and that portion of the previously compacted asphalt where that end's sensor is positioned. That sensor would indicate to the operator that the bottom face of the roller is not at the same elevation as the previously compacted asphalt, and additional rolling is required. The sensors are used to indicate to the operator when the 8 to 12 inches, more or less, of asphalt not previously rolled by conventional rollers, has been sufficiently rolled to compact the given amount of hot mix asphalt into the desired given space. The sensors achieve this by indicating to the operator when both ends of roller 704 or 706 are at the same elevations as that portion of the previously compacted surface of asphalt. This will allow for the plane of the surface of the previously compacted asphalt to be extended, along the entire length of roller 704 or 706, to the edge of the asphalt at roller 250.

The use of sensors is the means for the operator to be able to know when there has been sufficient rolling done to extend and match the plane of the surface of the previously compacted asphalt, onto the surface of the 8 to 12 inches, more or less, of uncompacted asphalt.

Other variants are possible without departing from the scope of this invention.

What is claimed is:

1. Apparatus for controlling side edge confinement force applied to an asphalt concrete lane by a compacting vehicle of the type including (a) a horizontal cylindrical compacting roller having a first end, and (b) substantially vertical side edge confinement force means carried by said compacting roller and extending downwardly below and adjacent to said first end of said compacting roller, and wherein the asphalt concrete lane includes a defined edge which is the actual oath of said asphalt concrete lane, the apparatus comprising:

(a) means for receiving position information of the exact path of said defined edge;

(b) linear actuation means, responsive to said position information, for moving said horizontal compacting roller so that said compacting roller and said side edge confinement force means follow said exact path of said defined edge and compact said asphalt concrete lane to provide uniform density.

2. Apparatus for compacting asphalt concrete comprising:

(a) a frame member;

(b) first and second cylindrical rollers carried by said frame; wherein each said roller is adapted to rotate about a horizontal axis; wherein each said roller is adapted to pivot independently relative to said frame; and wherein each said roller includes a first end;

(c) substantially vertical side edge confinement force means carried by each said roller and being positioned adjacent to said first end of each said roller; wherein each said side edge confinement force means is adapted to be moved between a raised position and a lowered Position relative to said first end of a respective one of said cylindrical rollers; wherein said side edge confinement force means includes a lower edge which does not extend below said cylindrical roller when said side edge confinement force means is in said raised position; and wherein said side edge confinement force means remains adjacent to said first end of each said roller in said raised position and also in said lowered position.

3. Apparatus in accordance with claim 2, further comprising first and second yokes and yoke pins for attaching said first and second cylindrical rollers, respectively, to said frame member.

4. Apparatus in accordance with claim 2, further comprising means for selectively raising or lowering each said side edge confinement force means.

5. Apparatus in accordance with claim 2, wherein each said side edge confinement force means comprises a roller.

6. Apparatus in accordance with claim 2, further comprising proximity sensors positioned forwardly of said first cylindrical roller for monitoring the position and planarity of said asphalt concrete.

* * * * *